US010550603B2

(12) United States Patent
Alzingre et al.

(10) Patent No.: US 10,550,603 B2
(45) Date of Patent: Feb. 4, 2020

(54) SHOCK-RESISTANT MOTORIZED LOCKING DEVICE

(71) Applicant: Cogelec, Mortagne sur Sevre (FR)

(72) Inventors: Jean-Daniel Alzingre, Larnod (FR); Guillaume Keltz, Chatillon-le-Duc (FR)

(73) Assignee: COGELEC, Mortagne sur Sevre (FR)

( * ) Notice: Subject to any disclaimer, the term of this patent is extended or adjusted under 35 U.S.C. 154(b) by 203 days.

(21) Appl. No.: 14/425,467

(22) PCT Filed: Jul. 30, 2013

(86) PCT No.: PCT/FR2013/051835
§ 371 (c)(1),
(2) Date: Mar. 3, 2015

(87) PCT Pub. No.: WO2014/037639
PCT Pub. Date: Mar. 13, 2014

(65) Prior Publication Data
US 2015/0225983 A1 Aug. 13, 2015

(30) Foreign Application Priority Data
Sep. 4, 2012 (FR) ..... 12 58222

(51) Int. Cl.

| | |
|---|---|
| ***E05B 47/00*** | (2006.01) |
| ***E05C 1/08*** | (2006.01) |
| ***E05B 47/06*** | (2006.01) |
| ***E05B 15/00*** | (2006.01) |
| ***H01F 7/14*** | (2006.01) |

(52) U.S. Cl.
CPC ..... *E05B 47/0001* (2013.01); *E05B 15/0073* (2013.01); *E05B 47/0005* (2013.01); *E05B 47/0603* (2013.01); *E05C 1/08* (2013.01); *H01F 7/14* (2013.01); *E05B 2047/0074* (2013.01); *E05B 2047/0093* (2013.01); *Y10T 292/102* (2015.04); *Y10T 292/11* (2015.04); *Y10T 292/62* (2015.04); *Y10T 292/96* (2015.04)

(58) Field of Classification Search
CPC ..... E05B 47/0001; E05B 47/0005; E05B 47/0603; E05B 2047/0074; E05B 2047/0093; E05C 1/08; H01F 7/14; Y10T 292/102; Y10T 292/96; Y10T 292/62; Y10T 292/11
USPC ..... 292/251.5, 359, 337, 143; 70/276, 278, 70/283
See application file for complete search history.

(56) References Cited

U.S. PATENT DOCUMENTS 5,010,750 A * 4/1991 Boser ..... E05B 47/063 70/276
5,592,838 A * 1/1997 Clark ..... E05B 37/00 292/251.5

FOREIGN PATENT DOCUMENTS

EP 2412901 A1 2/2012
FR 2945065 A1 11/2010

* cited by examiner

*Primary Examiner* — Kristina R Fulton
*Assistant Examiner* — Faria F Ahmad
(74) *Attorney, Agent, or Firm* — Occhiuti & Rohlicek LLP

(57) ABSTRACT

A locking device includes a mobile locking member, movement of which can be prevented by a blocking member interacting with a motorized lever, where the motorized lever is capable of rotational movement about an axis with respect to the supporting structure, the centre of gravity of the lever lying on the axis, the lever being kept in a (Continued)

determined stable position and without rigid mechanical contact of the lever with the supporting structure apart from its axis of rotation.

18 Claims, 5 Drawing Sheets

SHOCK-RESISTANT MOTORIZED LOCKING DEVICE

CROSS-REFERENCE TO RELATED APPLICATIONS

This application is a National Phase Entry of International Application No. PCT/FR2013/051835, filed on Jul. 30, 2013, which claims priority to French Patent Application Serial No. 1258222, filed on Sep. 4, 2012, both of which are incorporated by reference herein.

TECHNICAL FIELD

The invention relates to the field of electrical devices providing a locking function, such as, for example motorized locks or mechatronic positioning assemblies, having an electrical actuating element and a pivot lever ensuring the locking of the device. The present invention more particularly relates to the behaviour of high security locks, which have a high resistance to mechanical shocks delivered during an external attack of the device. The invention also relates to a mechatronic system having to withstand an external shock or a high frequency vibration, like those which actuators aboard automobiles or airplanes can be subjected to during an accident.

BACKGROUND

French Patent FR2945065 is known in the prior art, which describes an electronic lock comprising a stator and a rotor mounted to rotate in the stator with a rotor blocking member which can move between a locking position where it is engaged with the rotor to prevent the rotation thereof, and a retracted position where the rotation of the rotor is released. A movable stop can move between a first position where it opposes the movement of the locking member and a second position where the locking member is free to leave its locking position. The mobile stop comprises a permanently magnetized part able to retain the mobile stop in the first position, i.e. resting against a stationary stop without consuming energy when jerks are applied to the lock.

The European patent EP2412901 discloses another exemplary electronic lock, comprising a stator and a rotor, a rotor locking member and a lever which can move between a locking position and an unlocking position. A memorizing arm rotates between a rest and memorizing position, by the action of a magnet. This arm comes in contact with a mechanical stop.

In the electronic lock solutions of the prior art, the locking member is in contact, when at rest as well as in the locked position, with a mechanical stop against which it rests. The untimely unlocking of this member can thus be caused by applying violent or periodic shocks, at a given frequency. The vibrations of the shocks applied to the supporting structure are transmitted to the mobile member by the stop, and the transmitted energy causes the movement of the member and the undesired release of the bolt. The person skilled in the art thus faces a paradoxical situation where the mechanical locking of a locking member must be provided while avoiding any mechanical contact which might cause the transmission of mechanical energy.

SUMMARY

The invention, in its broadest sense, relates to a locking device comprising a mobile locking member the movement of which can be prevented by a blocking member interacting with a motorized lever, where the motorized lever is capable of rotational movement about an axis with respect to the supporting structure, with the centre of gravity of said lever being located on said axis, with said lever being kept in a determined stable position and without rigid mechanical contact of the lever with the supporting structure apart from its axis of rotation. The mechanical wave propagating through a structure upon an impact is transferred to the locking lever by the points of mechanical contacts thereof with the stationary supporting structure. The shock wave thus propagates through the pivot axis, on the one hand, and by the catching device (at the aforementioned point of contact) on the other hand. If the device is insensitive to what is transmitted by the axis because of the lever balance, it is, on the contrary, sensitive to the force transmitted to the magnetic catching contact. This can be compared to what happens in Newton's cradle when the end ball is ejected because of the kinetic energy that is transmitted thereto by the dropped ball.

Whatever the catching effort generated between the rotating lever and the supporting structure, a shock having a sufficient intensity to eject the lever from its stable position and thus to unlock the lock may thus always be liable to propagate. The invention thus provides a locking device comprising an electrical actuator moving, within a supporting structure, a locking lever capable of rotational movement about a stationary axis with respect to the supporting structure, with the centre of gravity of said lever being located on said stationary axis, where the lever is held in a determined stable position and, at rest, without rigid mechanical contact of the lever with the supporting structure apart from the connection of its axis of rotation. Within the scope of this patent, "at rest" means the state of the device when locked and when no effort is exerted on any of the components thereof.

The concept of rigid mechanical contact is generally implemented when the lever is in mechanical contact with a rigid part integral with the supporting structure. Such rigid connection then transmits the impact energy to the lever when the supporting structure is hit. On the contrary, the invention eliminates the rigid connection between the supporting structure and the lever to make the lever insensitive to any external shock since the impact energy is never transmitted anywhere but at the centre of gravity of the lever, which does not generate any rotation torque and ensures the holding in position thereof. The stable position is advantageously achieved without any power consumption.

Various embodiments of this function have been considered. The suspension of the lever without any rigid contact can thus be obtained using resilient elements (at least one mechanical spring) or preferably using magnetic elements (a link without magnet/magnet or magnet/ferromagnetic material contact). This suspension may be separate, or integrated in the locking lever actuating means. Such suspension means without rigid contact create a mechanical filter of the "low-pass" type which excludes any transmission of shocks and high frequency vibrations (with respect to the resonance frequency of the device).

In a particular embodiment, the actuator moving the locking lever also provides the magnetic force keeping the position of the lever stable. The invention also aims at providing an actuator for a locking device which drives a locking lever in rotation about a stationary axis, wherein the centre of gravity of the locking lever is held on said stationary axis and in that the actuator comprises at least one magnet and has a variable air gap ensuring a stable position without any power consumption. Advantageously, the air gap is minimum when the lever is in its stable locked position and maximum in the unlocked position.

BRIEF DESCRIPTION OF THE FIGURES

The relevance of the invention will be better understood when reading the following description of the various figures, which show various possible configurations.

DETAILED DESCRIPTION

Figure 1:
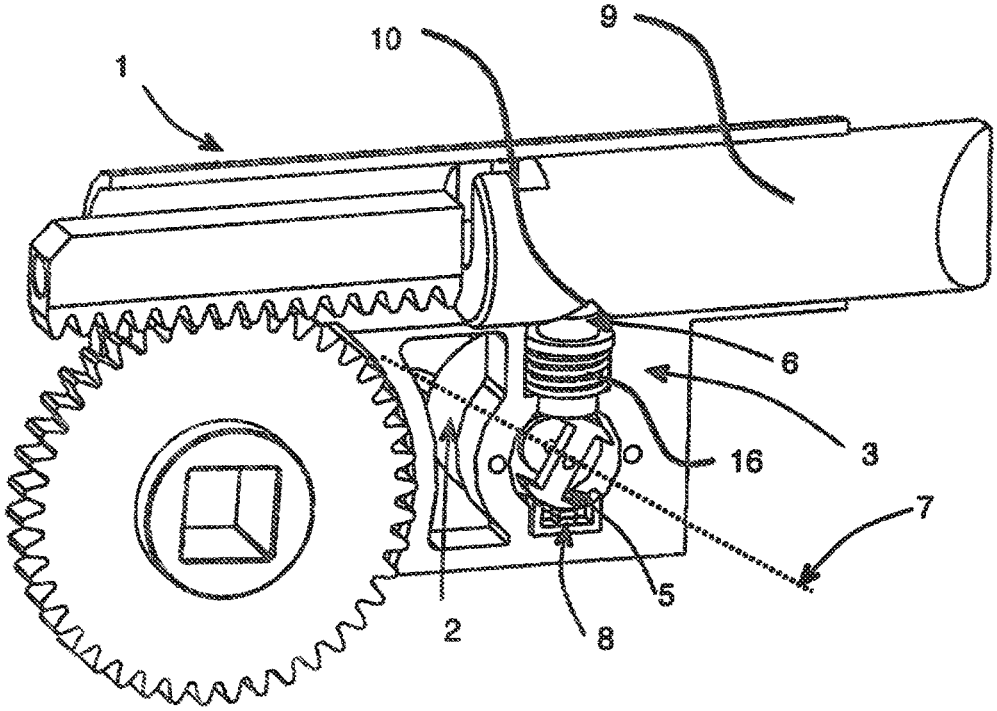
FIG. 1 is a perspective representation of a complete electromechanical lock device based on the use of an electric motor and a contactless stabilizing device according to a first embodiment.

The following description refers to a non-restrictive exemplary embodiment as a lock with a mobile bolt. But the invention is not limited to the embodiment of a lock and extends to any type of locking device comprising a mobile member which can be temporarily immobilized by means of a motorized member interacting with a motorized lever.

The described exemplary embodiments are not restrictive and relate to a lock 1 comprising a supporting structure 3, and a bolt 9 mobile by translation with respect to the supporting structure 3, the movement of which can be blocked by the head of a piston 6 engaging in a housing 10. Such piston 6 is mobile in translation, in a direction perpendicular to the direction of movement of the bolt 9. A spring 16 urges the piston 6 at rest towards the bolt 9, so as to keep the piston head in the position where it is engaged in the housing 10. The piston head 6 has a truncated or conical shape, matching the shape of the housing 10, so that the movement of the bolt 9 pushes the piston 6 back, because of the transverse component (perpendicular to the axis of movement of the bolt 9) of the forces exerted by the inner edge of the housing 10 on the piston head 6.

The lock further comprises a lever 5 which can move between a locking position where it prevents the movement of the piston 6, and thus the disengagement of the head thereof, and an unlocking position which enables the movement of the piston and the release of the bolt 9 when the piston head 6 is fully extended out of the housing 10. The aim of the invention is to prevent shocks exerted on the bolt 9 or any other accessible part of the lock from propagating to the lever 5 with enough energy to cause the untimely movement thereof from the locking position to another position where it would no longer provide the locking of the piston 6 movement.

FIGS. 1, 2*a*, 2*b* and 2*c* show a motorized locking device 1 according to a first embodiment. Such lock mechanism comprises a rotating actuator 2, integral with the supporting structure 3, electrically controlled by a polyphase switched motor, a torque motor or still a proportional angular or variable reluctance actuator. The rotor of the actuator 2 is mechanically coupled to the locking lever 5, the design of which enables the latter to clear the passage of a third part (the piston 6 in the drawing) when it has completed the rotational movement generated by the supply of the actuator 2.

The lever 5 has, in association with the rotor of the actuator 2 which it is attached to, a centre of gravity on its axis of rotation 7. According to this embodiment, the lever 5 is made of a ferromagnetic material. The lever 5 is thus sensitive to the magnetic field generated by a polarized (=magnetized) structure 8 integral with the supporting structure 3. The magnetic circuit is so designed that it generates a stable position of the lever in at least one position. Thus, when the actuator 2 is not energized, the rotor assembly is subjected to a magnetic attraction, via the lever 5, which tends to re-position the latter in the vertical stable position. Having several stable positions (locked and unlocked states) is also conceivable in other mechanisms.

Figures 2A, 2B, 2C:
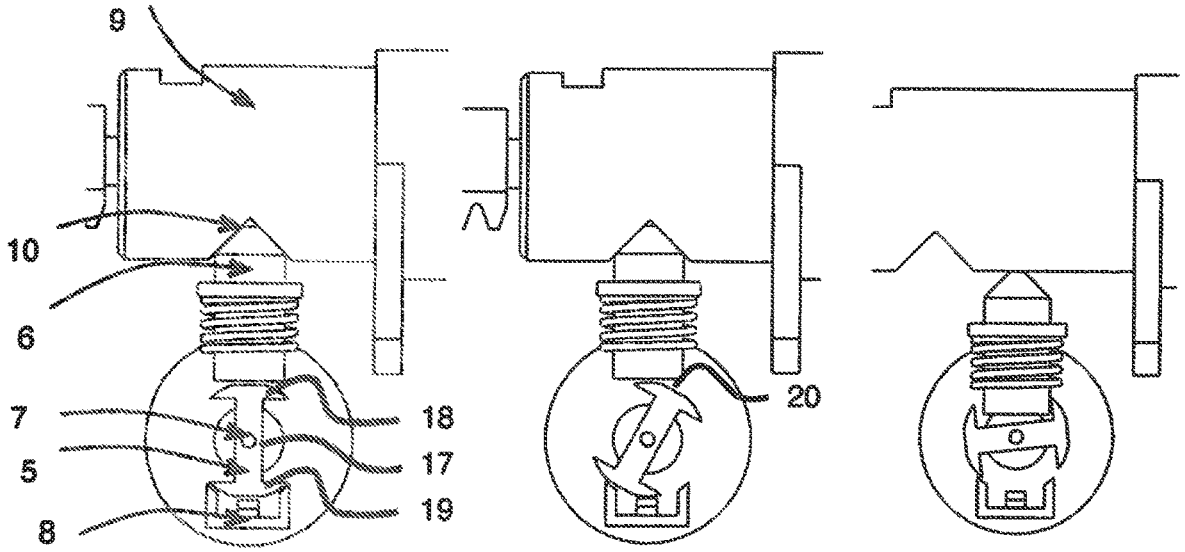
FIGS. 2*a*, 2*b* and 2*c* are detailed front views of the device of FIG. 1, shown in three different states.

From left to right, FIGS. 2*a*, 2*b* and 2*c* show three operating states of a locking device using the first embodiment. FIG. 2*a* shows the locked state. The bolt 9 is shown in the extended position. A piston 6 having a linear stroke is engaged in the bolt 9 in high position under the action of the spring 16.

It cannot go down because of the presence of the locking lever 5. The piston 6 can engage into the bolt 9 thanks to a housing 10 provided in the bolt 9. Thus, if a force is applied to the bolt 9 so as to make the latter translate, such force is transmitted to the piston 6 according to two components. A horizontal component supported by the supporting structure 3 and, on the other hand, a lower vertical component, transmitted to the locking lever 5. As the lever is in its vertical stable position, it transmits such force to the supporting structure, because of an elastic deformation of the axis which connects it to the motor, or of the support of the actuator 2. Thus, the piston 6 cannot be released from the bolt 9, and the lock is locked.

FIG. 2*b* shows the lever 5 when driven in rotation by the actuator 2 supplied with electric current. Under the action of the torque created, which has a higher intensity than the magneto-static torque generated by the polarized structure 8 which tends to hold it in a stable vertical position, the lever 5 is pivoted.

FIG. 2*c* shows the mechanism in the unlocked position. The bolt 9 is subjected to a force which tends to make it translate. Because of the respective shapes of the piston 6 and of the bolt 9, the piston 6 is driven in translation. Since the lever 5 has pivoted, the piston 6 can travel on to be completely disengaged from the bolt 9. The lock will then be in an unlocked state.

Figure 3:
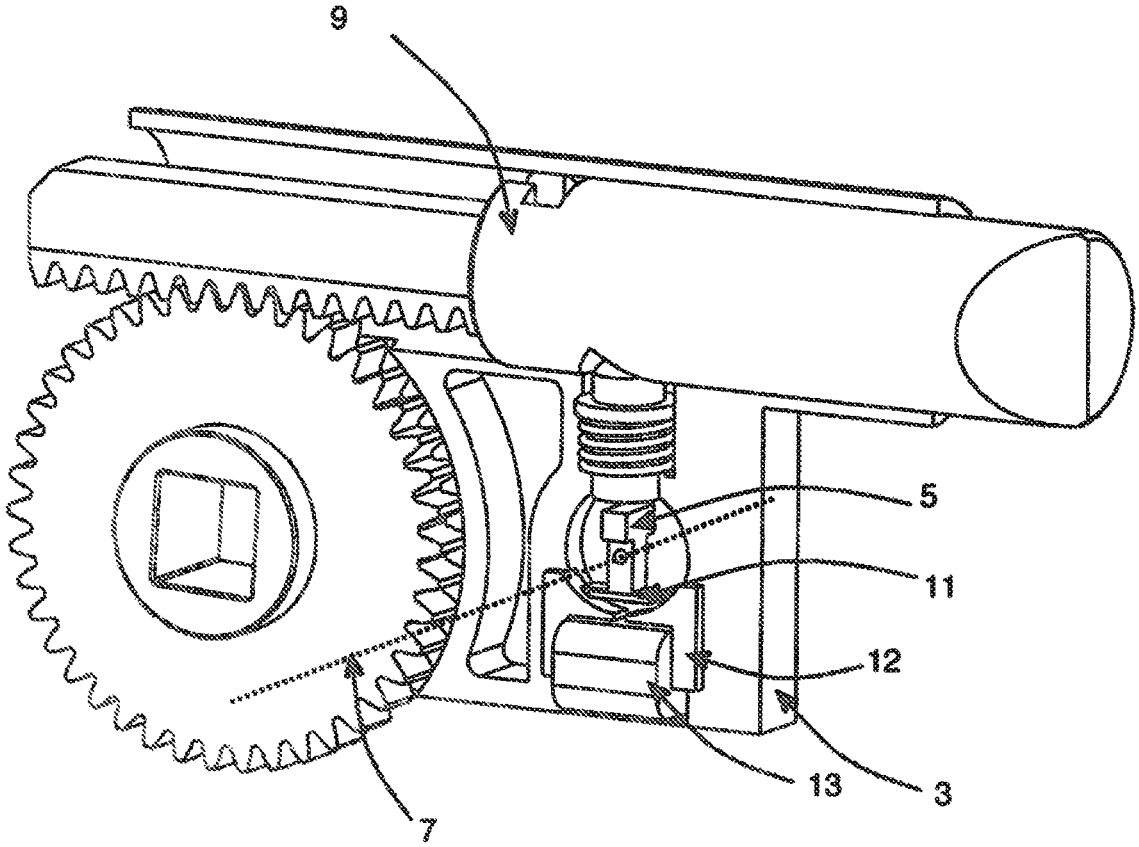
FIG. 3 is a representation of the invention according to a second embodiment of the actuating device, which has an intrinsic characteristic of stability without current provided by the actuator.

FIGS. 3 and 4 show a second embodiment of a mechatronic locking device 1 according to the invention operated as described in the explanations of FIGS. 1, 2*a*, 2*b* and 2*c*. The difference relates to the locking lever 5 which is so designed as to provide the function of rotor to the actuator and the function of stability by magnetic interaction. The lever 5 is thus balanced and polarized by the addition of a magnet 11. A stator 12 fixed to the supporting structure 3 consists of ferromagnetic parts and is equipped with a magnetic field generating coil 13. When energizing the coil 13, the magnetic field produced is channelled by the ferromagnetic structure of the stator 12. The interaction with the magnetic field created by the magnet 11 of the lever 5 generates a couple between the lever 5 and the stator 11, which induces the rotation of the lever 5. The assembly is so designed that the air gap between the lever 5 and the stator 11 varies according to the rotation of the lever 5. A minimum air gap can thus be achieved when the lever 5 is in its stable position and a maximum air gap in the unlocked position thereof. In doing so, when the coil 13 is no longer energized, the lever 5 is subjected to a torque which tends to hold it in the stable position of the minimum air gap.

Figures 4A, 4B, 4C:
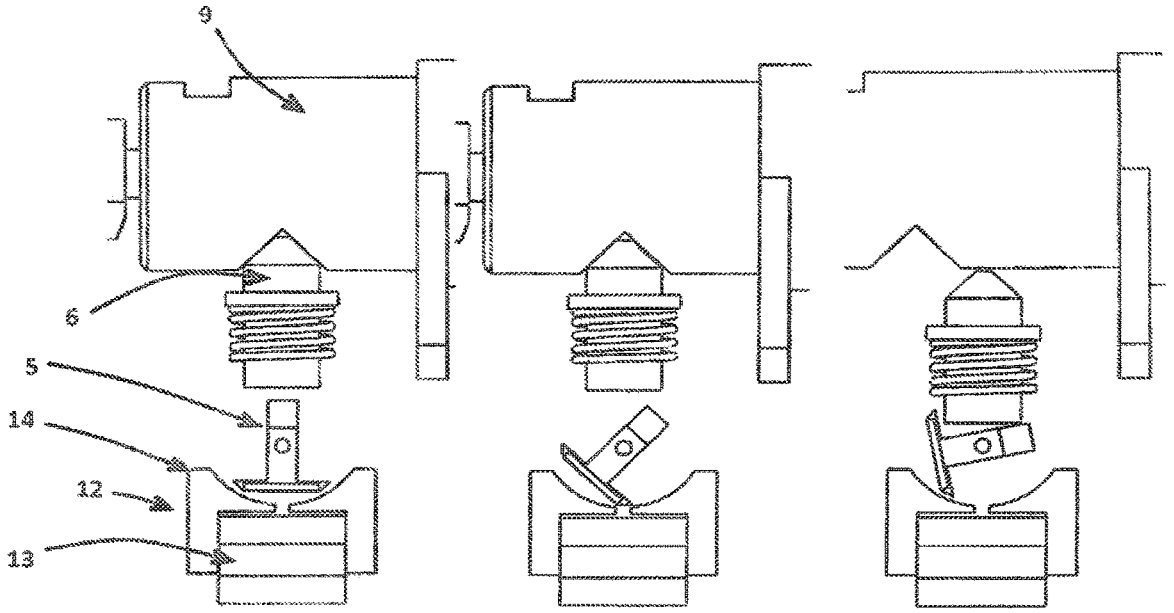
FIGS. 4*a*, 4*b* and 4*c* are detailed front views of the device of FIG. 3 shown in three different states.

In FIG. 4*a*, the device is shown in the locked position. The piston 6 is engaged in the bolt 9 and its stroke is hampered by the vertical position of the locking lever 5. In this position, the air gap between the locking lever 5 and the poles 14 of the stator 12 is minimum. As the coil 13 is not energized, the torque applied without contact between the lever 5 and the stator 12 is null in this position. The torque on the lever 5, based on its position and on the current flowing through the coil 13 surrounding the stator 12 is shown in FIG. 5.

In FIG. 4*b*, the lever 5 is rotated when the coil 13 is energized. The air gap is then more important than when the lever 5 is vertical. The result is that, if the current in the coil is cancelled 13, a magneto-static torque (=with no current) will be created and will drive the lever 5 to the stable position of minimum air gap.

Eventually, in FIG. 4*c*, the device is shown in an unlocked state. The lever 5 has been rotated from its vertical position, thus releasing the piston 6 which is then liable to go down under the action of a force exerted on the bolt 9.

Figure 5:
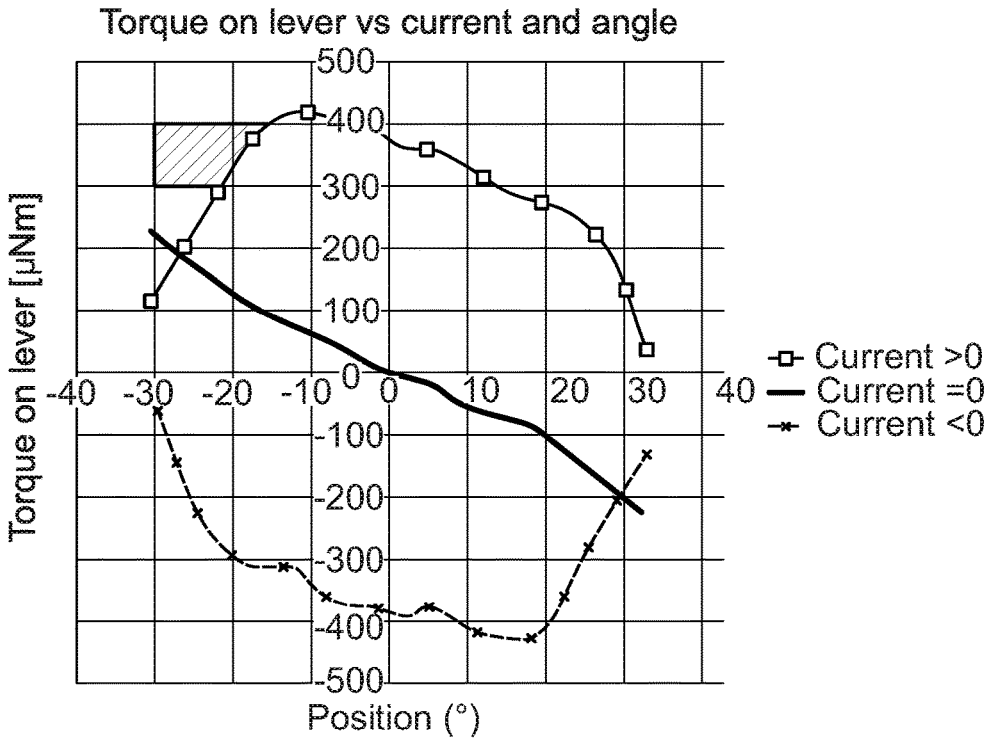
FIG. 5 is a plot of the torque exerted on the locking lever according to the power supply to the actuator and to the position of the lever according to the embodiment shown in FIG. 3.

FIG. 5 shows the torques obtained on the axis of the locking lever of an actuator as shown in the descriptions of FIGS. 3, 4*a*, 4*b* and 4*c*. The vertical stable position with the minimum air gap corresponds to the 0° position. Because the air gap increases with the rotation of the lever 5, the torque without current in the coil 13 follows the central solid curve, which can be compared to a mechanical stiffness having a magnetic origin. The lower—crosses—and upper—squares—curves are the torques obtained for opposite current polarities in the coil 13. Moving from the 0° locked position to the −30° unlocked position can be achieved by applying a >0 current in the coil 13.

Figure 6:
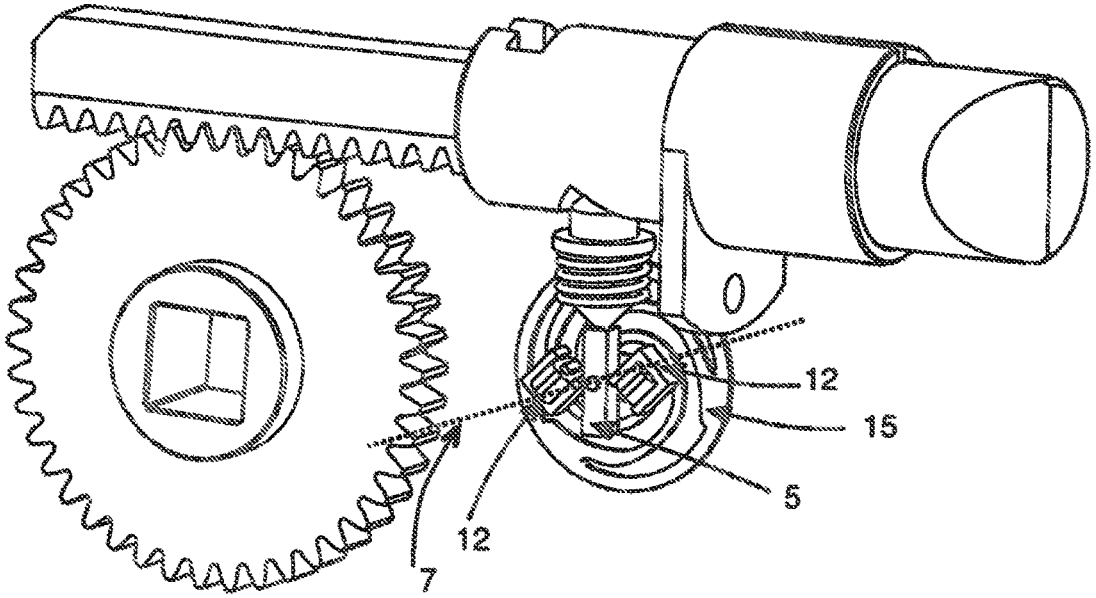
FIG. 6 is a perspective view of a complete electromechanical lock device according to a third embodiment based on the use of an actuator of the vane solenoid type and of a stabilizer based on elastic springs.

FIG. 6 shows an embodiment of the invention based on the use of a rotary actuator of the solenoid type as shown, for example, in the patent FR2834119. Such structure has no magnet, and may be doubled to increase the torque on the lever 5. When the coil 13 is energized, the magnetic flux generated is channelled by the stator 12, and the stator 12 is composed of two separate parts, and loops back through the ferromagnetic locking lever 5. In doing so, an attractive force is generated between the stator 12 and the lever 5. Since the actuator 2 is not polarized, a mechanical spring 15 is used here to ensure the stability of the lever 5 in vertical position. The mechanical spring 15 is advantageously attached to the lever 5, close to the axis of rotation, in order to dampen the transmission of the shock wave when the lock 1 is subjected to an external shock.

Figures 7A, 7B, 7C:
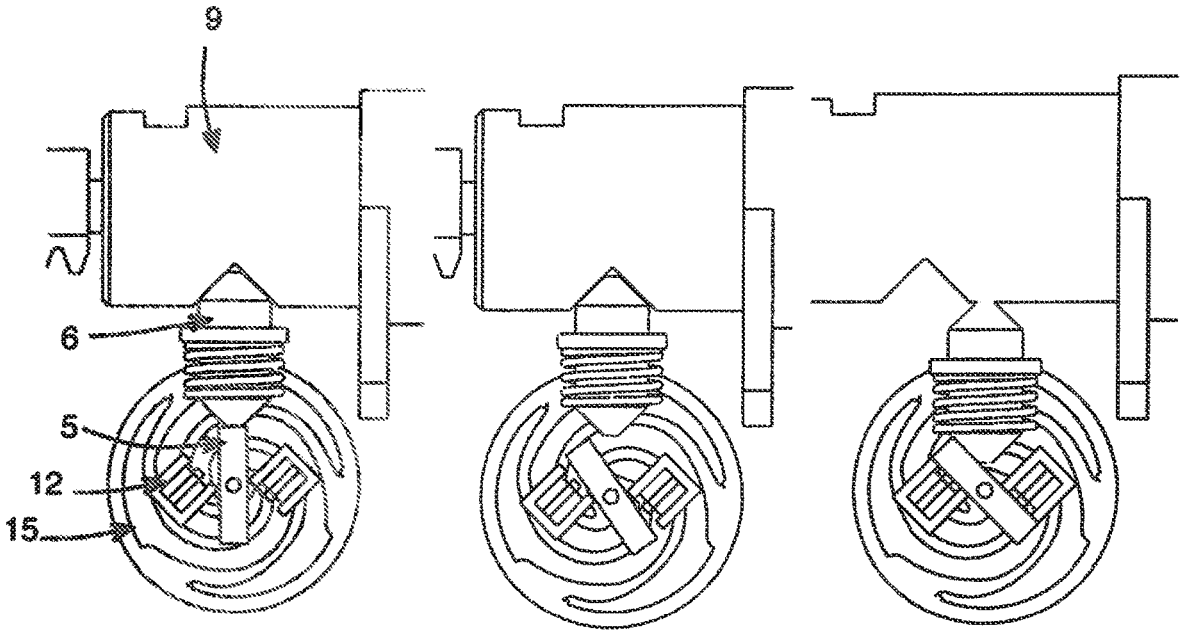
FIGS. 7*a*, 7*b* and 7*c* are detailed front views of 3 states of the structure shown in FIG. 6.

FIGS. 7*a*, 7*b* and 7*c* show, in detail, the three distinct states of the solution presented in FIG. 6. In FIG. 7*a*, the lever 5 is held in a stable position without current by the resilient rigidity of the torsion spring. In FIG. 7*b*, energizing the coils 12 generates a torque on the locking lever 5 which pivots while compressing the torsion spring 15. In FIG. 7*c*, the lever 5 has travelled on its entire stroke, under the action of the magnetic field generated by the stator 12. The piston 6 can then slide and release the bolt 9.

Figure 8A:
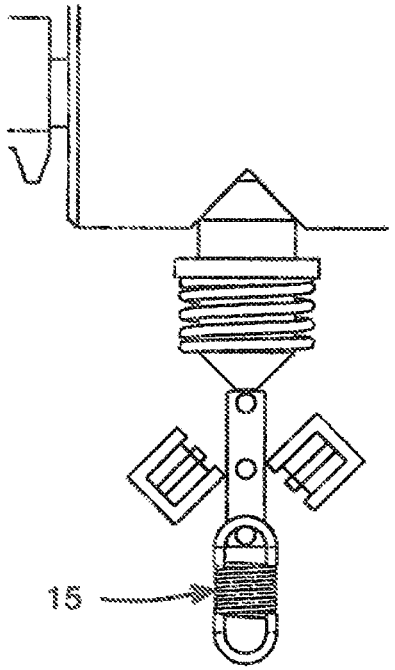
FIGS. 8*a* and 8*b* are detailed front views of 2 states of an alternative structure shown in FIG. 6.
Figure 8B:
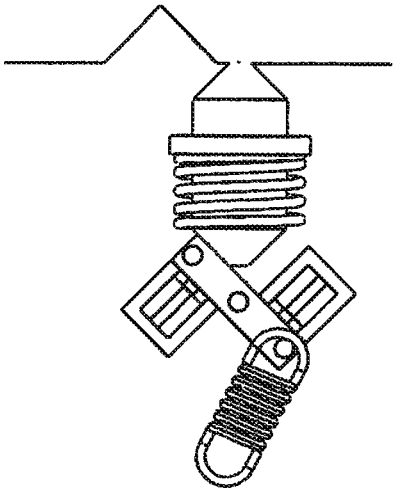

FIGS. 8*a* and 8*b* show an embodiment of the invention as shown in FIG. 6, with the difference that the mechanical spring 15 used is of the linear type (a torsion spring here). FIGS. 8*a* and 8*b* show the device in the locked and unlocked conditions, respectively.

The invention claimed is:

1. An apparatus comprising a locking device, said locking device comprising a supporting structure, a mobile locking-member, a piston, a motorized lever, and an actuator, wherein the mobile locking member comprises a housing wherein the actuator comprises a magnet, a stator, and an air gap, wherein the piston comprises a head, wherein the piston prevents movement of the mobile locking-member by engaging the head in the housing, wherein the motorized lever interacts with the piston, wherein the motorized lever is capable of rotational movement about an axis that is stationary with respect to the supporting structure, wherein the motorized lever moves between a locking position and an unlocking position, wherein the locking position is a stable locking-position, wherein, in the locking position, the motorized lever prevents movement of the piston and disengagement of the head thereof from the housing, wherein, in the unlocking position, the motorized lever enables movement of the piston and the release of the locking member when the head is fully extended out of the housing, wherein a center of gravity of the lever is located on the axis, wherein the motorized lever is held stable in the locking position and without rigid mechanical contact between the motorized lever with the supporting structure apart from the connection of its axis of rotation with the supporting structure, wherein the actuator drives the motorized lever to rotate about the stationary axis, wherein the magnet is fixed to the motorized lever, wherein the stator is fixed to the supporting structure, wherein the stator comprises ferromagnetic parts and a coil wherein the coil is a magnetic-field generating coil that produces a magnetic field when energized, wherein the stator's ferromagnetic parts channel the magnetic field, wherein interaction of the magnetic field and the magnet fixed to the motorized lever couples the motorized lever and the stator, wherein as a result of the coupling between the motorized lever and the stator, the motorized lever is induced to rotate, wherein the air gap is between the motorized lever and the stator, wherein the air gap varies in response to the rotation of the motorized lever, wherein the air gap has a minimum width when the motorized lever is in the stable locking position, wherein the air gap has a maximum width when the motorized lever is in the unlocked position, and wherein, when the field-generating coil is no longer energized, the motorized lever remains subjected to a torque that tends to hold the motorized lever in the stable locking position in which the air gap has a minimum width, wherein said torque arises from interaction of said magnet and said ferromagnetic parts.

2. The apparatus of claim 1, wherein the stable locking-position is achieved without any power consumption.

3. The apparatus of claim 2, wherein the stable locking-position is achieved by the action of a magnetic force acting without any mechanical contact on the lever.

4. The apparatus of claim 3, wherein the actuator provides the magnetic force that maintains the stable position of the lever.

5. The apparatus of claim 2, further comprising a mechanical spring, wherein the stable locking-position is achieved at least in part by action of the mechanical spring.

6. An apparatus comprising a locking device, wherein the locking device comprises a supporting structure, a mobile locking bolt that is linearly moveable along an axis thereof between extended and retracted positions, a tapered piston that is vertically moveable from a blocking position to an unblocking position, wherein, as a result of being tapered, the tapered piston prevents the bolt from moving from the extended position to the retracted position when the tapered piston is in the blocking position, wherein the tapered piston moves in a direction that is angularly offset from the axis, an elongated lever rotatable about a pivot between a locking orientation aligned with the direction in which the tapered piston moves and an unlocking orientation angularly offset from the locking orientation, the lever being rotatable about a stationary axis, the stationary axis being stationary relative to the supporting structure, wherein a center of gravity of the elongated lever is at said stationary axis, a magnet on the elongated lever, and a structure that is located adjacent to the lever, and that, in operation, attracts the elongated lever toward one of the orientations, wherein the structure is a stationary and magnetizable structure that comprises a stator that comprises ferromagnetic parts and a coil that, when energized, generates a magnetic field, the ferromagnetic parts of the stator being configured to channel the magnetic field produced by the coil so that the magnetic field produced by the coil couples to the magnet that is on the elongated lever and thereby, as a result of the coupling, the magnetic field produced by the coil induces rotation of the elongated lever, wherein an air gap between the elongated lever and the stator has a width that varies as the elongated lever rotates about the stationary axis, wherein the width of the air gap varies between a minimum value, which is reached when the elongated lever is in a stable locking position, and a maximum value, which is reached when the elongated lever is in an unlocked position, wherein, when the coil is no longer energized, the motorized lever is subjected to a torque that tends to hold the motorized lever in an orientation that minimizes the width of the air gap, wherein said torque arises from interaction of said magnet and said ferromagnetic parts.

7. The apparatus of claim 6, wherein, with the exception of a surface of the pivot, all surfaces of the elongated lever are spaced away from all surfaces that are adjacent to the elongated lever when the elongated lever is in the locking orientation.

8. The apparatus of claim 6, wherein an end of the elongated lever is wider than a width of the lever at the pivot.

9. The apparatus of claim 6, wherein the magnetizable structure generates magnetism to attract the elongated lever toward the locking orientation, the magnetizable structure including a ferromagnetic material.

10. The apparatus of claim 6, wherein the elongated lever includes a magnet adjacent to the stator.

11. The apparatus of claim 6, wherein the stator is located on a line that is parallel to the axis of the bolt, and wherein the line extends along the elongated lever and runs through the pivot of the elongated lever.

12. An apparatus comprising a locking device, wherein the locking device comprises a supporting structure, an electromagnetically-movable locking bolt having a housing, a piston that is moveable between a first position and a second position, wherein in the first position the piston engages a head thereof the housing of the bolt and wherein in the second position the piston disengages the head thereof from the bolt, a lever that is rotatable about a pivot between locking and unlocking orientations, wherein the lever has a wide end and a narrow center, wherein the lever rotates about an axis that is stationary relative to the supporting structure, wherein the lever has a center of gravity that coincides with the axis that is stationary relative to the supporting structure, an end of the piston having a width less than a linear dimension between the wider ends of the lever when the lever is rotated to the unlocking orientation; and a stationary magnetizable structure that is located on an opposite side of the pivot from the bolt, the stationary magnetizable structure including a stator having ferromagnetic parts and a magnetic-field generating coil that, when energized, generates a magnetic field that is channeled by the ferromagnetic parts and couples to a magnet on the lever so as to induce rotation of the lever, the lever and the stator being separated by an air gap having a width that varies between a maximum and a minimum as the lever rotates, the minimum being reached when the lever is in a stable locking position and the maximum being reached when the lever is in an unlocking position, wherein, when the coil is no longer energized, the lever is subjected to a torque that tends to hold the lever in a position that minimizes the air gap, wherein said torque arises from interaction of said magnet and said ferromagnetic parts.

13. A locking device according to claim 12, wherein the pivot has surfaces, among which is a surface that is adjacent to the pivot, wherein, with the exception of a surface adjacent to the pivot, all the surfaces of the lever are spaced away from all surfaces that are adjacent to the lever when the lever is in the locking orientation.

14. The apparatus of claim 12, wherein: the bolt is linearly moveable when the piston is in the disengaged position, wherein, in operation, the magnetizable structure generates magnetism to attract the lever toward the locking orientation, and wherein the magnetizable structure comprises ferromagnetic material.

15. The apparatus of claim 12, further comprising a motorized actuator operable to rotate the lever, wherein a center of gravity of the lever is located at the pivot.

16. The apparatus of claim 1, wherein the torque varies as a function of an extent to which the motorized lever deviates from the stable locking position a torque is exerted that urges the motorized lever back to the stable locking position.

17. The apparatus of claim 1, wherein, after having been energized, when the field-generating coil is no longer energized, movement of the motorized lever away from the stable locking position gives rise to a torque that urges the motorized lever back to the stable locking position.

18. The apparatus of claim 6, wherein the tapered piston is vertically movable from a blocking position to an unblocking position.

* * * * *